United States Patent [19]

Alcalde Cilveti

[11] 4,027,449

[45] June 7, 1977

[54] SYSTEM FOR CONSTRUCTING SPATIAL STRUCTURES

[76] Inventor: Francisco-Javier Alcalde Cilveti, Plaza Conde Rodezno,, 8-4° Pamplona (Navarna), Spain

[22] Filed: May 13, 1976

[21] Appl. No.: 686,233

Related U.S. Application Data

[63] Continuation of Ser. No. 328,078, Jan. 30, 1973, abandoned.

[52] U.S. Cl. ..... 52/648; 403/171; 403/176

[51] Int. Cl.[2] ..... E04H 12/06

[58] Field of Search ..... 403/171, 176, 172; 52/758 C, 758 R, 648, 655, 81, 650; 46/29

[56] References Cited

UNITED STATES PATENTS

| | | | |
|---|---|---|---|
| 288,319 | 11/1883 | Edsall | 52/758 C |
| 1,554,224 | 9/1925 | McGrath | 52/758 C |
| 1,667,256 | 4/1928 | Herrschaft | 46/29 |
| 1,691,818 | 11/1928 | Kraft | 52/648 |
| 2,682,235 | 6/1954 | Fuller | 52/81 |
| 2,703,157 | 3/1955 | Goldberg | 403/262 |
| 2,780,484 | 2/1957 | Frye | 46/29 |
| 3,192,669 | 7/1965 | Hawkins | 52/758 |
| 3,220,152 | 11/1965 | Sturm | 52/81 |
| 3,332,195 | 7/1967 | Foster | 52/655 |
| 3,563,581 | 2/1971 | Sommerstein | 52/758 C |
| 3,789,562 | 2/1974 | DeChicchis | 52/648 |
| 3,882,650 | 5/1975 | Gugliotta | 403/176 |

FOREIGN PATENTS OR APPLICATIONS

| | | | |
|---|---|---|---|
| 477,946 | 10/1951 | Canada | 46/29 |
| 1,391,973 | 2/1965 | France | 403/171 |
| 58,807 | 1/1967 | Germany | 52/81 |
| 257,209 | 8/1926 | United Kingdom | 52/758 R |

*Primary Examiner*—Ernest R. Purser
*Assistant Examiner*—Henry Raduazo
*Attorney, Agent, or Firm*—Wenderoth, Lind & Ponack

[57] ABSTRACT

A system for constructing spatial structures includes a nucleus into which a series of tubes lead, the tubes connecting adjacent nuclei. The nucleus is substantially spherical and hollow and is formed to two helmet-shaped pieces of different heights, having in their corresponding mouthpieces, flat annular fins which, when confronting each other, form flanges for coupling, by means of screws, the two pieces. The surface of the hollow sphere forming the nucleus has flat, round, annular, surfaced openings suitable for receiving the ends of the tubes to form the structure.

6 Claims, 10 Drawing Figures

SYSTEM FOR CONSTRUCTING SPATIAL STRUCTURES

This is a continuation of application Ser. No. 328,078, filed Jan. 30, 1973 now abandoned.

BACKGROUND OF THE INVENTION

The present invention relates to systems for constructing spatial structures.

Presently, the assessment of loads, the distribution of stresses or forces, moment losses and the obtention of the maximum advantage of the material used, are the trends demanded or required by architects and engineers. At the same time, these requirements have resulted in a new method of construction, known as spatial structure. In this new shape and size architecture, technical advantages and architectural beauty are in close harmony. Up to a certain point the spatial structure can be considered as an extension into space of the conventional frame structure systems, in which the lines of action of the stresses are coplanar, while in spatial structures the lines of action of the stresses are branched outwardly into space. In spatial structures, the tensions or stresses on the various struts or tubes are largely uniform, without one thereof being overloaded, the structure thus having a great resistance to outer stresses. The inner tensions or stresses diminish, thus the necessary sections of the drawn or compressed elements also diminish, which results in a remarkable decrease in the amount of necessary material.

Furthermore, there are other factors which lead to greater economy and which justify the growing use of spatial structures. Such factors are: prefabrication of the essential elements, their standardization and savings in labor.

For example, spatial structure concepts have been used in domes or arches which cover a space of 200 meters without the use of intermediate columns. Presently, projects which contemplate the covering of surfaces up to 400 meters in diameter are being studied.

A comparison of weights between a spatial structure and a lineal bearing element structure would, in principle and on an approximate basis, result in a weight of 30 to 50% for a spatial structure having a distance of up to 50 meters between the supports, in comparison with a comparable lineal structure.

In the field of spatial structures and in order to achieve the objects of the invention the following concepts were fundamentally taken into account:

a. Structural system whose main feature is its high degree of hyperstaticity.

b. The use of soldered or welded nuclei for two layers spatial structures is only profitable with a distance of 40 meters between the supports. However, and even from these distances, a screw bearing an axial load cannot be replaced during assembly, since the structure is successfully positioned only with the help of a screwdriver. These conclusions were reached after various trials and experiments.

In order to meet these requirements the following should be fulfilled:

1. Connection or coupling by means of screws or bolts.
2. Surveying nucleus.
3. Transmission of tensions or stresses from the tubes to the axially shaped nucleus.

SUMMARY OF THE INVENTION

The present invention meets these conditions, thus having the following advantages:

1. Relatively light weight and large distances between supports.
2. Easy construction and assembly.
3. Possibility of constructing false roofs, directly applied to the struts or tubes having a cross-section approximately in the shape of the Greek letter omega, and to other struts of different cross-section.
4. Direct attachment of the roof or cover to the structure by means of flat attachment supports, allowing, in the case of struts having a cross-section in the form of the Greek letter omega, the use of assemblies onto wooden straightedges in order to diminish the problems of condensation and noise between the roof and the structure.
5. Simple mechanization.
6. Possibility of constructing structures which can be adapted to flat, curved, square, rectangular, hexagonal, circular, etc. roofs.

From the above it can be established that the term "spatial structure" refers to an assembly of tubes or struts which lead into and from and connect adjacent nuclei to which the ends of such struts or tubes are attached.

An object of the present invention is to provide means for constructing or shaping a spatial structure from hollow nuclei or hubs formed by two parts which can be joined together to form such hub or nucleus, and to which a predetermined number of struts or tubes of a desired profile are attached by means of screws or bolts.

Another object of the present invention is to provide means for joining the tubes and the adjacent nuclei, such joining means having a cross-section corresponding to that of the tubes.

Another object of the present invention is the provision of fins incorporated in the complementary pieces of each nuclei which form flanges for attachment of the pieces to form the nucleus of the structure.

BRIEF DESCRIPTION OF THE DRAWINGS

The accompanying drawings represent the following.

DETAILED DESCRIPTION OF THE INVENTION

With FIGS. 1 to 5 in mind, it can be seen that the nucleus or hub of a spatial structure according to the present invention is formed by means of combining two hollow pieces 1 and 2, preferably obtained by stamping. Each one of these pieces has a partial spherical helmet shape, the height of the hollow piece 1 being different than the height of the complementary piece 2. This difference in height of pieces 1 and 2, which together form a substantially spherical nucleus, has the purpose of avoiding interference between the horizontal tubes and the supports which form the flanged coupling of the pieces forming the nucleus. Such flanged coupling is formed by confronting fins 3 extending outwardly from the openings of hollow pieces 1 and 2. Such fins 3 are preferably annular.

Figure 1:
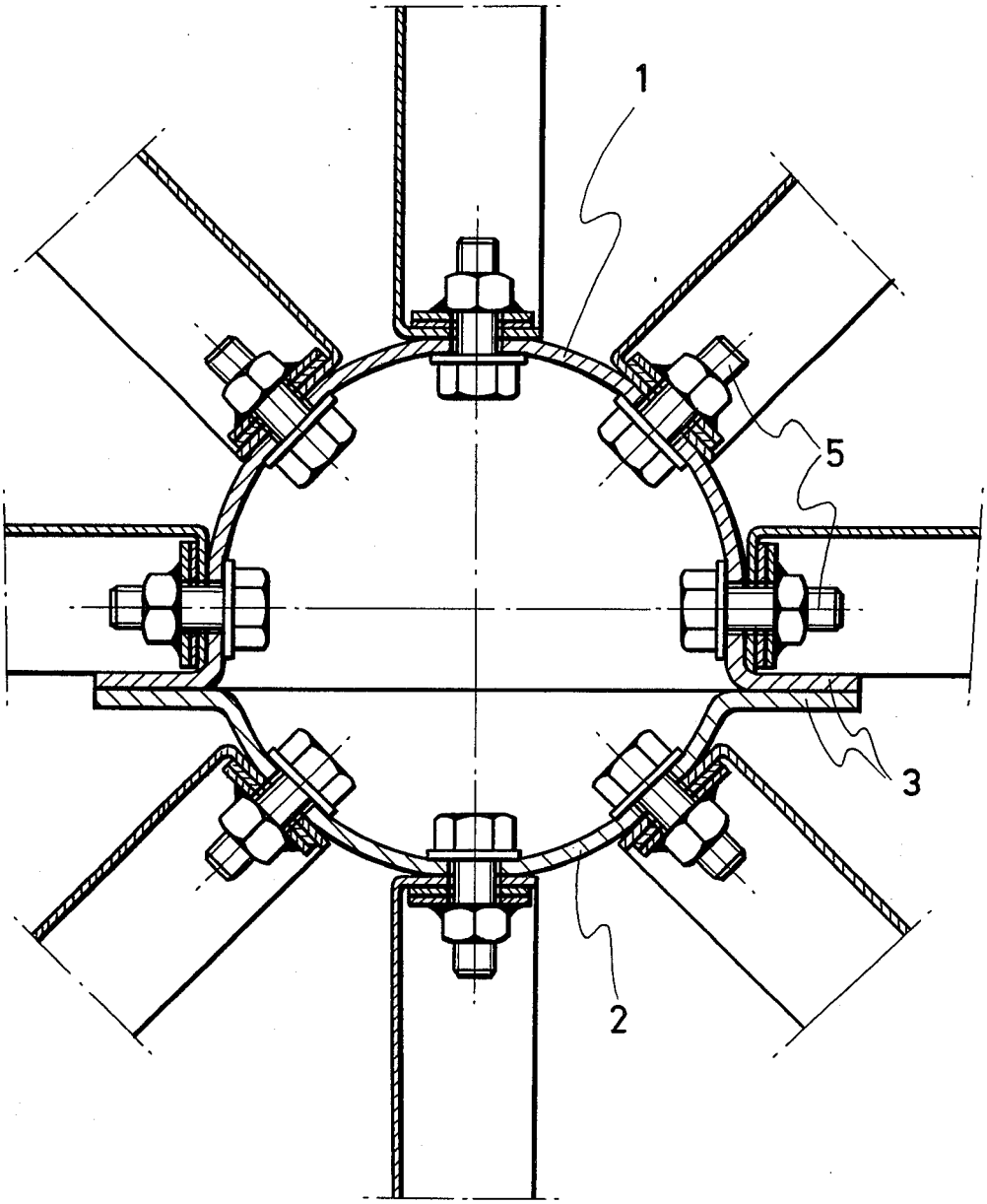
FIG. 1 is a section view showing the geometrical shape of the two parts comprising the spatial nucleus to which the ends of the tubes are coupled.

The flange which forms the screwed coupling of the spherical helmet pieces 1 and 2 can be positioned as shown in FIG. 1, i.e. extending parallel with the plane cutting the nuclei to form the two pieces 1 and 2, or such fins 3 can be slightly inclined with regards pieces 1 and 2 to which they respectively pertain in order to thus constitute a radial flange. This position is the most suitable sinc it allows for easier assembly of the tubes which lead into the nucleus, the ends of such tubes having a considerable size.

At certain points on the surfaces of the helmet shaped pieces 1 and 2 there are a series of openings 4 which each have therearound a flat, round, annular surface 6, so that there may be substantial contact on flat surface 6 by the surface of the free end of the tube which is attached to the nucleus, or by an auxiliary piece fixed to the end of the tube. The thus attached plurality of tubes and nuclei together form the spatial structure.

Figure 2:
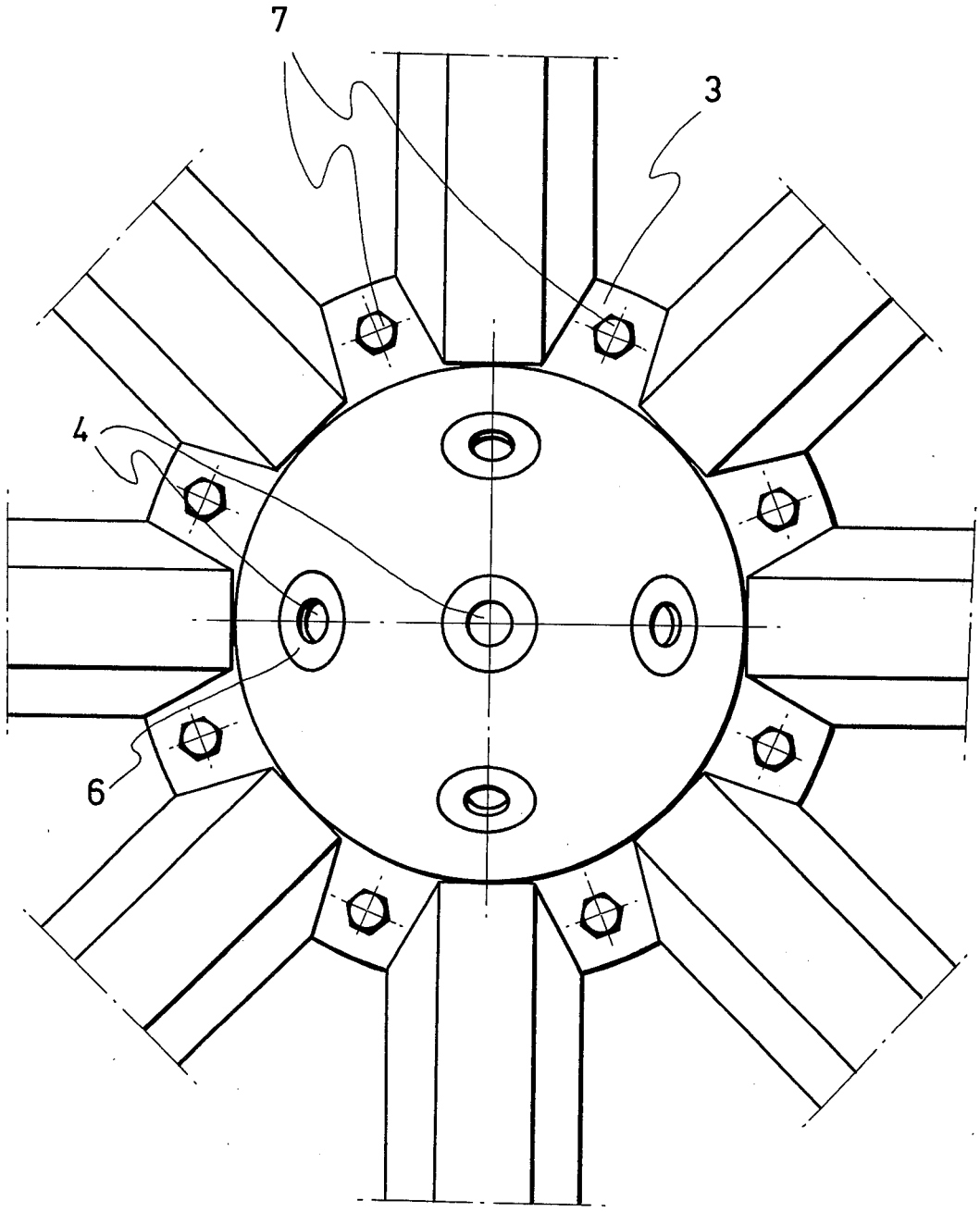
FIG. 2 is a plan view of the assembly of the two parts comprising the nucleus.

The flanged coupling of the partial spherical helmet shaped pieces 1 and 2 is carried out by means of screws or bolts 7 such as those shown in FIG. 2, while the joining of the tubes to the nucleus is carried out by means of screws or bolts 5, in such a way that the screws 5 are screwed in previously fixed nuts, for example by means of soldering or welding as shown in FIG. 1, in the ends of the tubes to be attached to the spatial nucleus.

Figure 3:
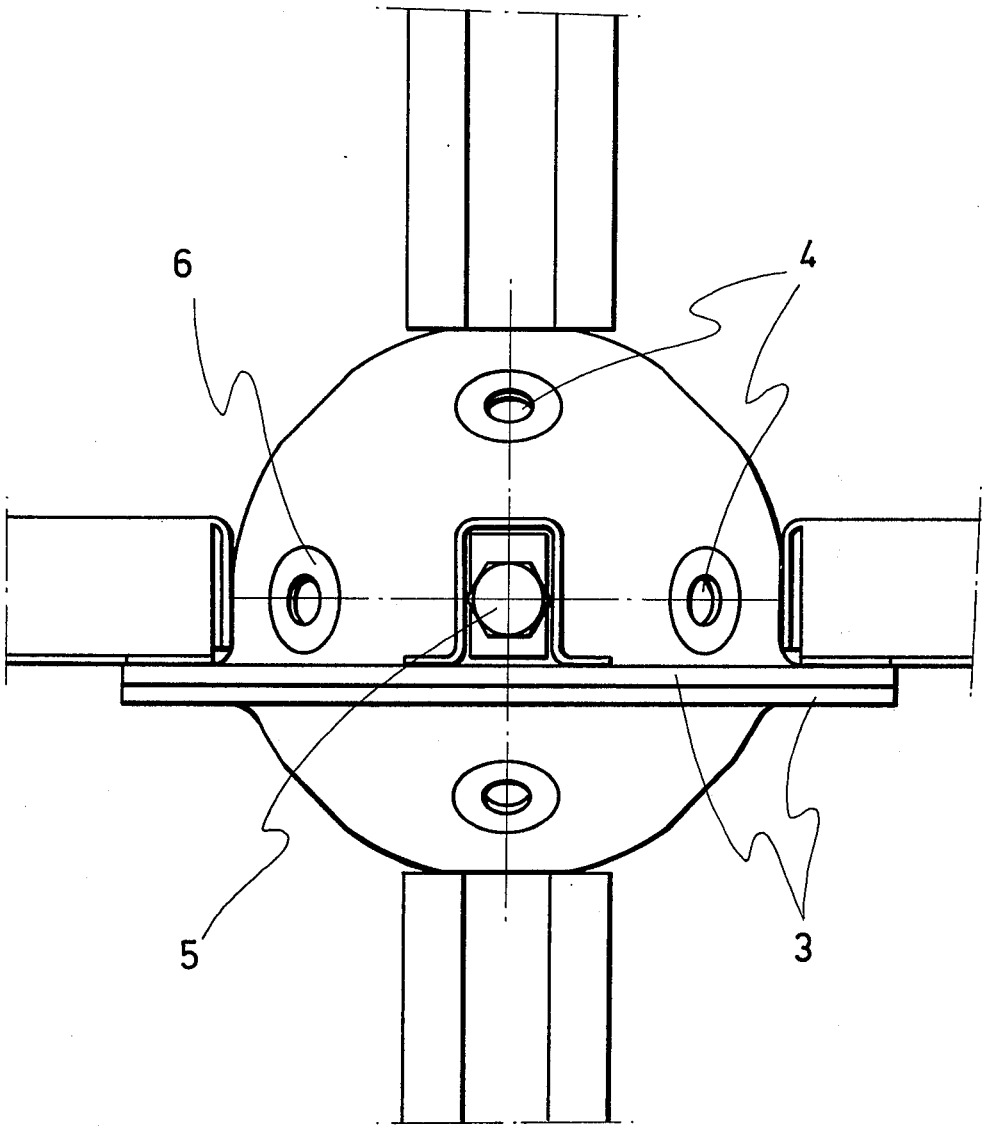
FIG. 3 is an elevational view of a nucleus to which tubes having a section in the form of the Greek letter omega are attached.
Figure 4:
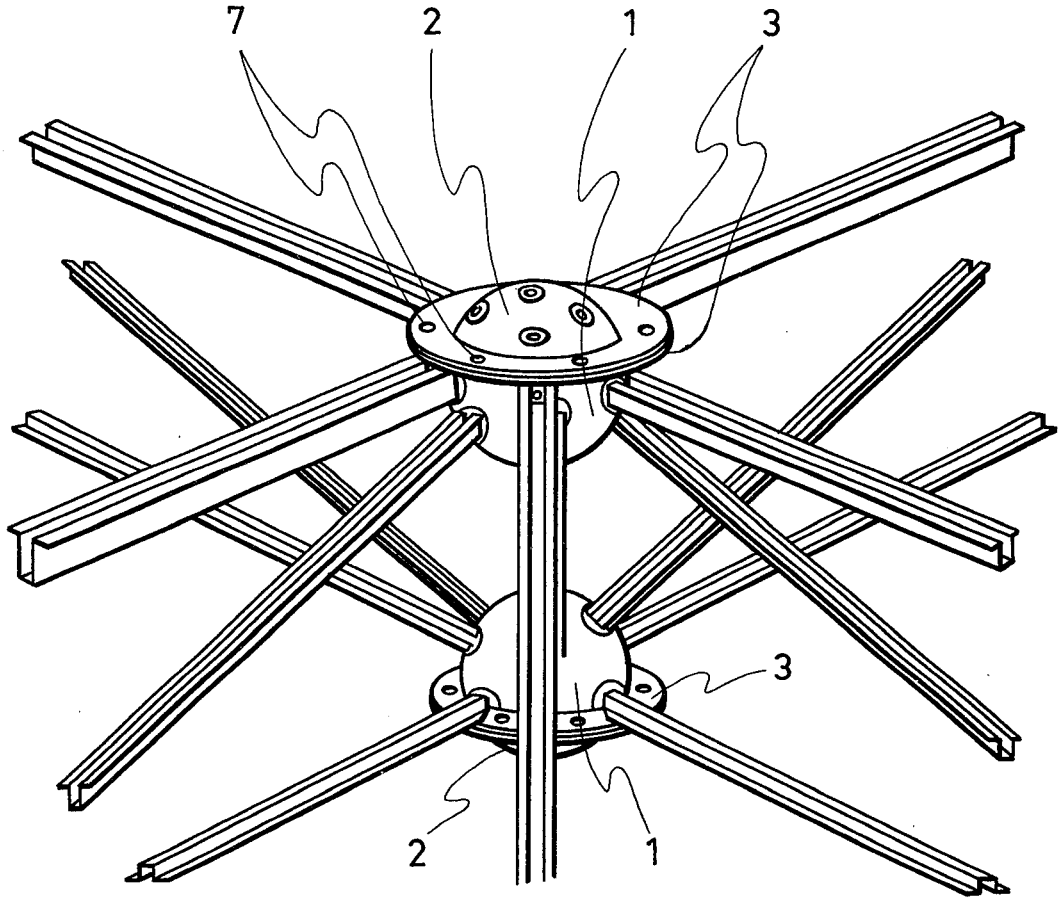
FIG. 4 is a perspective view showing one manner of assembling the plural tubes to a plurality of nuclei.
Figure 6:
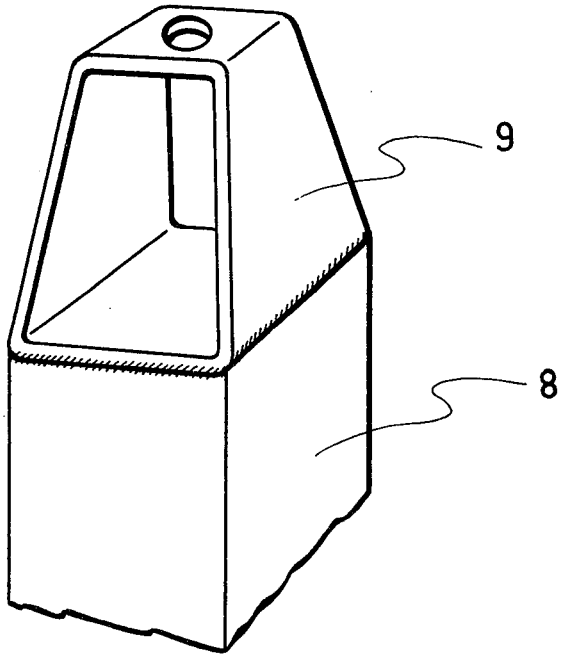
FIG. 6 is a perspective detail view of the end of a tube having a square cross-section connected to an auxiliary piece for attaching the tube to the nucleus.

When tubes or struts having transversal cross-sections substantially in the form of the Greek letter omega, are used, such as those shown in FIGS. 2, 3 and 4, the ends of such tubes will be folded in such a way that a flat wall, complementary to the flat annular surface 6 of the corresponding opening 4 of the nucleus on which the tube is to be arranged, is formed. The nut to which the corresponding screw 5 will be screwed, is thus soldered or welded on the inside of the mentioned fold.

When the tubes used in the construction of the spatial structure have a circular or polygonal cross-section, for example squared, suitable auxiliary means for coupling the tubes to the nucleus have been provided. Such means are shown in FIGS. 5 to 10.

Figure 5:
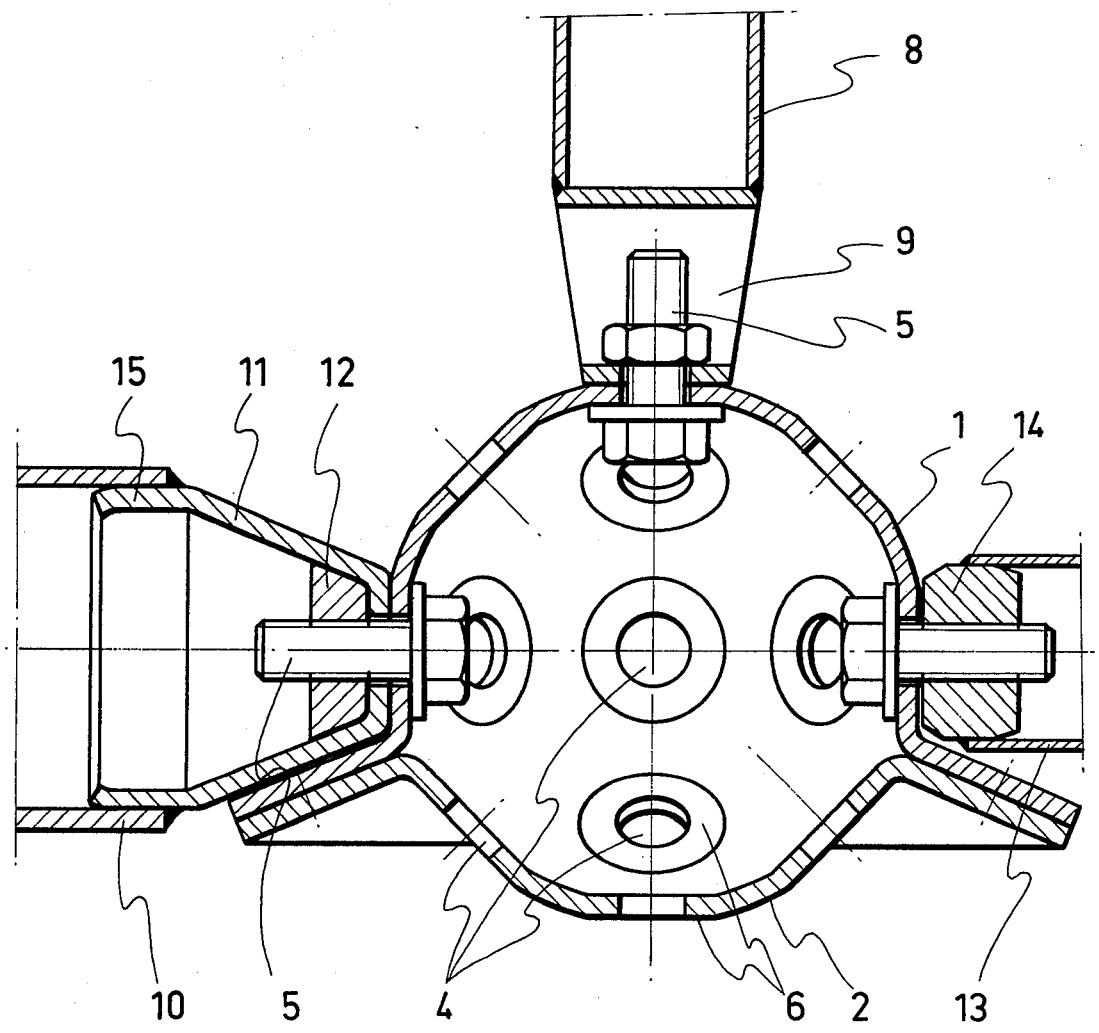
FIG. 5 is a section view similar to that of FIG. 1 but with the fins forming the connection between the parts of the spatial nucleus being radially oriented with regard to the substantially spherical hollow piece which constitutes the spatial nucleus.

The mentioned coupling means for attaching round or squared tubes to the nucleus comprise pieces which have a general structure depending on the section of the tube, i.e. whether it deals with a tube having a circular or polygonal cross-section, such as a square cross-section. Thus, in the case of tubes 8, having a square cross-section, an auxiliary piece 9 in FIG. 6, will be arranged. This piece is shaped substantially in the form of a hollow frustum of a pyramid which lacks two of its opposite side surfaces. The larger base of pyramid frustum auxiliary piece 9 is soldered or welded to one of the open ends of the tube 8 having a square cross-section, while the smaller base of piece 9 has an opening for receipt of a screw 5 as shown in FIG. 5. This screw will join the assembly formed by tube 8 and piece 9 to the spatial nucleus, when the screw is screwed into a nut 12 arranged against the internal surface of the smaller base of piece 9.

Figure 7:
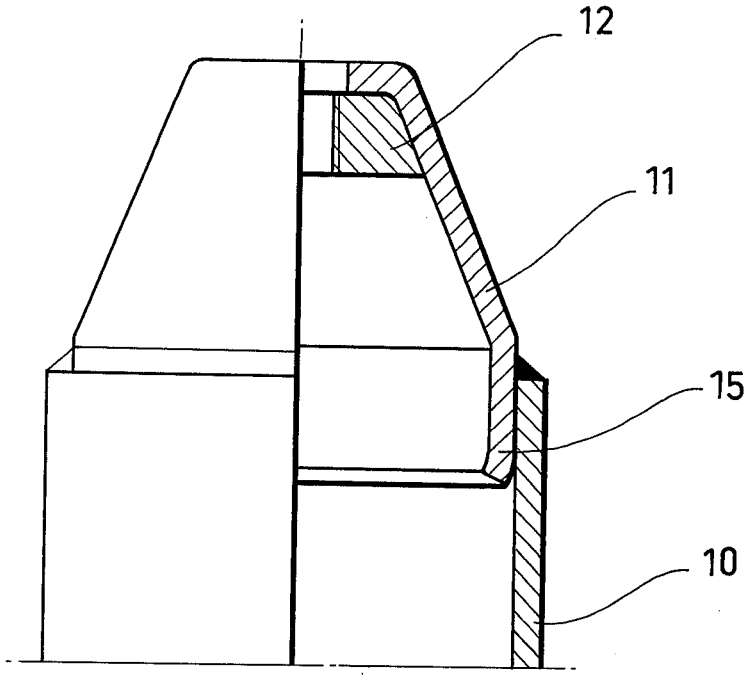
FIG. 7 is a partially sectioned elevational view of the end of a tube having a circular section, to one end of which an auxiliary piece for joining the tube to the nucleus has been attached.
Figure 8:
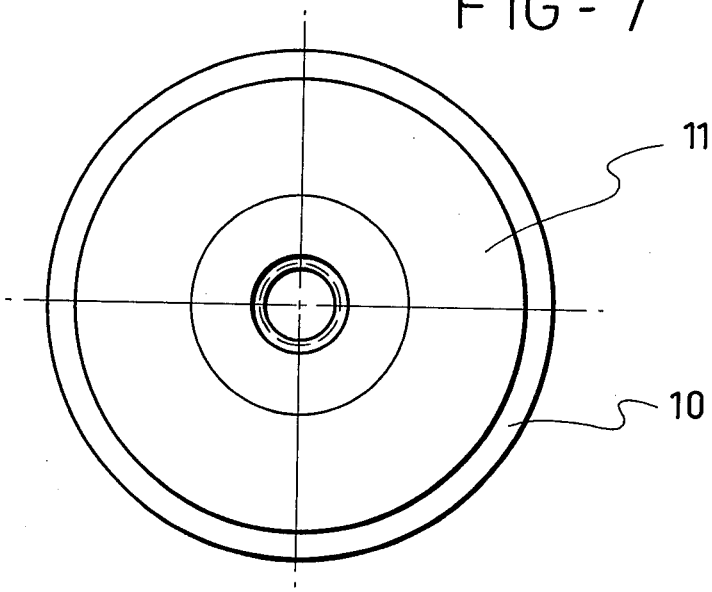
FIG. 8 is a plan view of the device shown in FIG. 7.

When tubes having circular sections are used, two types of different auxiliary pieces for joining such round tubes to the spatial nucleus can be used. In the embodiment of FIGS. 7 and 8, the round tube 10 will receive, at one of its ends, a predominantly hollow truncated cone piece 11 which, at its larger base, has a cylindrical skirt 15 having an external diameter equal to the internal diameter of tube 10, in such a way that penetration of the cylindrical skirt 15 into an open end of the round tube 10 and the adequate soldering or welding of such parts permit the mounting of the assembly on any opening 4 of the spatial nucleus. Such coupling, normally by means of screws, is carried out by screwing the corresponding stem of a screw 5 into a solid piece 12 soldered or welded to the interior of the hollow truncated cone 11 against the smaller base thereof. Such smaller base has an opening therein for receipt of the coupling screw to the spatial nucleus.

Figure 9:
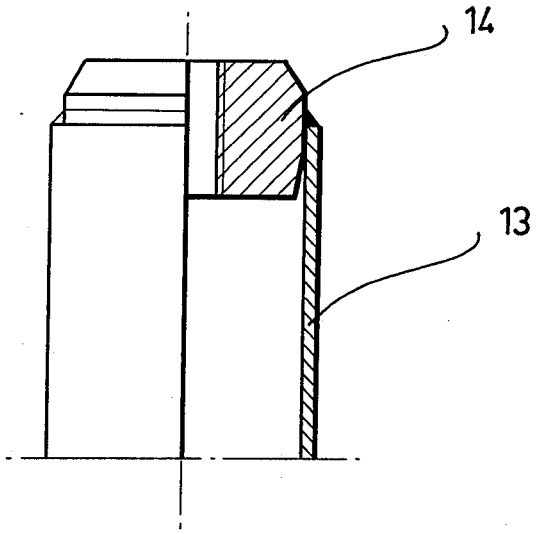
FIG. 9 is a partially sectioned elevational view of the end of a tube having a circular section, to one open end of which another type of auxiliary piece for joining the tube to the nucleus has been attached.
Figure 10:
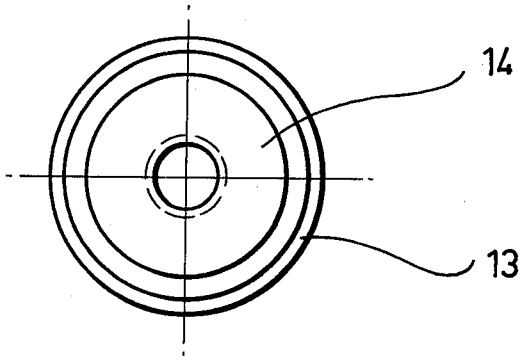
FIG. 10 is a plan view of the device shown in FIG. 9.

As a variant of the mode of assembling a round tube to the spatial nucleus, another type of auxiliary piece, which is shown in FIGS. 9 and 10 and which comprises a simple solid cylinder 14 having an external diameter equal to the internal diameter of a round tube 13, has been provided. Piece 14 is soldered to one of the open ends of tube 13, coupling being effected to the spatial nucleus by means of a screw which is screwed into the axial opening in piece 14.

The mounting or assembly of the spatial structure according to the present invention can be carried out on the floor using a number of screws per square meter of structure which ranges between 15 and 30 for distances of 15 to 50 meters between supports, subsequently raising the structure, in sections, up to its final position.

In a lineal structure, longitudinal elements of approximately 8 to 10 meters should be constructed and assembled on the spot and each unit should be raised by using belts or similar means.

Maximum advantage in mounting will be reached when the sections to be mounted in the spatial structure are as few as possible, taking advantage of the inherent and exclusive structural characteristics of the invention.

I claim:

1. In a spatial structure including a plurality of hollow hubs or nuclei joined by a plurality of struts or tubes attached at the opposite ends thereof to adjacent of said nuclei, the improvement comprising:

each of said nuclei being substantially sperically shaped;

each of said nuclei being formed of a first hollow partial spherical piece having an opening and a second hollow partial spherical piece having an opening, said first piece having a height different from that of said second piece, each of said pieces having annular fins extending outwardly from said respective openings in a radial direction from the center of said nucleus;

said pieces being aligned with said respective fins abutted together to form the respective substantially spherical nucleus having a completely hollow and empty interior, said abutted fins being rigidly fixed together by screw means, said thus abutted and fixed fins forming flange means for stiffening said nucleus against deformation stresses;

each of said pieces of each of said nuclei having therein a plurality of fastening holes, said nuclei each having on the exterior thereof, around each of said fastening holes, a flat annular surface formed in said nuclei;

bolt fastening means for rigidly attaching each of said tubes at both said ends thereof to said nuclei at said fastening holes in said pieces thereof, each said bolt fastening means having an integral head and threaded stem formed of a single element, said head having a planar surface abutting against and contacting the inner surface of the respective said nucleus at positions surrounding the respective said fastening hole, said threaded stem extending through said respective fastening hole and rigidly fastening to an end of the respective said tube; and said tubes each extending radially from the centers of each of the nuclei attached thereto.

2. The improvement claimed in claim 1, further comprising auxiliary attachment means at said end of said respective tube for rigid attachment to said threaded stem of said respective bolt fastening means.

3. The improvement claimed in claim 2, wherein said tube has a lateral cross-sectional shape substantially corresponding to the Greek letter omega; and said auxiliary attachment means comprises a transverse wall over said end of said tube and having an opening therein, said threaded stem extending through said opening, and a nut positioned interiorly of said wall and in threaded engagement with said threaded stem.

4. The improvement claimed in claim 2, wherein said tube has a rectangular lateral cross-sectional shape; and said auxiliary attachment means comprises an element having the shape of a frustum of a pyramid with two opposite sides removed, the larger base of said element being fixed to said end of said tube, the smaller base of said element having therein an opening, said threaded stem extending through said opening, and a nut positioned interiorly of said element and in threaded engagement with said threaded stem.

5. The improvement claimed in claim 2, wherein said tube has a circular lateral cross-sectional shape; and said auxiliary attachment means comprises an element having the shape of a hollow truncated cone, the larger base of said element being fixed to said end of said tube, the smaller base of said element having therein an opening, said threaded stem extending through said opening, and a solid piece rigidly fixed interiorly of said element adjacent said smaller base, said solid piece having therein a threaded opening in threaded engagement with said threaded screw.

6. The improvement claimed in claim 2, wherein said tube has a circular lateral cross-sectional shape; and said auxiliary attachment means comprises a cylindrical element positioned within said end of said tube and rigidly fixed thereto, said cylindrical element having a threaded opening therethrough in threaded engagement with said threaded stem.

* * * * *